US009725968B2

(12) United States Patent
Slocum et al.

(10) Patent No.: US 9,725,968 B2
(45) Date of Patent: Aug. 8, 2017

(54) FORCE APPLICATION REDUCTION EMPLOYING ACTUATOR AND THRUST BEARING

(71) Applicant: Canrig Drilling Technology Ltd., Houston, TX (US)

(72) Inventors: W. Randall Slocum, Houston, TX (US); Keith A. Hager, Spring, TX (US)

(73) Assignee: Canrig Drilling Technology Ltd., Houston, TX (US)

( * ) Notice: Subject to any disclaimer, the term of this patent is extended or adjusted under 35 U.S.C. 154(b) by 968 days.

(21) Appl. No.: 13/942,405

(22) Filed: Jul. 15, 2013

(65) Prior Publication Data

US 2015/0014066 A1 Jan. 15, 2015

(51) Int. Cl.
*E21B 19/086* (2006.01)

(52) U.S. Cl.
CPC ..... *E21B 19/086* (2013.01)

(58) Field of Classification Search
CPC ..... E21B 19/086; E21B 19/02
See application file for complete search history.

(56) References Cited

U.S. PATENT DOCUMENTS 3,869,781 A * 3/1975 Eubanks ..... H01R 43/052 29/33 M
4,813,498 A 3/1989 Lynch et al.
4,986,370 A * 1/1991 Johnson ..... E21B 19/086 173/141
5,265,683 A * 11/1993 Krasnov ..... E21B 3/02 173/164
6,000,472 A 12/1999 Albright et al.
6,230,821 B1 5/2001 Warren et al.
(Continued)

FOREIGN PATENT DOCUMENTS

WO WO 99/34088 7/1999
WO WO 2013/162970 10/2013

OTHER PUBLICATIONS

"Technical Bulletin Top Drive TD-500-HT Top Drive TD-350-HT," URL:http//drillzone.ru/uploads/files/18476723584dad37f38b896.pdf, Apr. 19, 2011, pp. 1-33.
(Continued)

*Primary Examiner* — David Andrews
*Assistant Examiner* — Kristyn Hall
(74) *Attorney, Agent, or Firm* — Haynes and Boone, LLP

(57) ABSTRACT

An apparatus includes a thrust bearing adapted to engage a tubular component. A bearing carrier is connected to the thrust bearing, an arm is connected to the bearing carrier, and an actuator is connected to the arm. In one embodiment, the bearing carrier includes an arcuate notch through which the tubular component is adapted to extend. In another embodiment, the apparatus has a first configuration in which a vertical offset is defined between the tubular component and the thrust bearing, and a second configuration in which the thrust bearing is engaged with the tubular component for the support thereof. In another embodiment, the apparatus is placed in the first configuration in response to a cessation of a supply of electrical power to a control valve in fluid communication with the actuator. In another embodiment, the tubular component is connected to, or is part of, a quill of a top drive.

17 Claims, 5 Drawing Sheets

(56) References Cited

U.S. PATENT DOCUMENTS

| | | | | |
|---|---|---|---|---|
| 6,968,900 | B2 | 11/2005 | Williams et al. | |
| 7,131,496 | B2 | 11/2006 | Williams et al. | |
| 7,654,325 | B2 | 2/2010 | Giroux et al. | |
| 7,857,076 | B2 | 12/2010 | Bui et al. | |
| 7,921,939 | B1 | 4/2011 | Keast et al. | |
| 7,931,077 | B2 | 4/2011 | Rudshaug et al. | |
| 7,984,757 | B1 | 7/2011 | Keast et al. | |
| 2002/0043403 | A1 | 4/2002 | Juhasz et al. | |
| 2008/0264648 | A1 | 10/2008 | Pietras et al. | |
| 2009/0151934 | A1* | 6/2009 | Heidecke ..... | E21B 3/02 166/250.01 |
| 2013/0284433 | A1 | 10/2013 | Weintraub et al. | |

OTHER PUBLICATIONS

PCT, "International Search Report," PCT/US2013/036974, Mar. 27, 2014.
U.S. Appl. No. 61/639,385, filed Apr. 27, 2012, Weintraub et al.
U.S. Appl. No. 13/864,025, filed Apr. 16, 2013, Weintraub et al.

* cited by examiner

FORCE APPLICATION REDUCTION EMPLOYING ACTUATOR AND THRUST BEARING

FIELD OF DISCLOSURE

The present disclosure relates, in general, to reducing the application of a force by a first device on a second device, which force is due, at least in part, to the weight of the first device.

BACKGROUND OF THE DISCLOSURE

An actuator may be employed to reduce the application of a force by a first device on a second device, which force is due, at least in part, to the weight of the first device. According to one aspect, the first device may be a quill of a top drive, and the second device may be a tubular member that is part of a string of drill pipe or casing employed, or to be employed, in oil and gas exploration and production operations.

In some cases, it may be difficult to service or replace the actuator or other components associated therewith. Further, a bearing assembly associated with the actuator and used to support the first device may quickly wear out or otherwise be susceptible to failure. Still further, the operation of one or more control valves, which control the actuator, may require a constant supply of electrical power. Therefore, what is needed is an apparatus or method that addresses the foregoing issues, among others.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
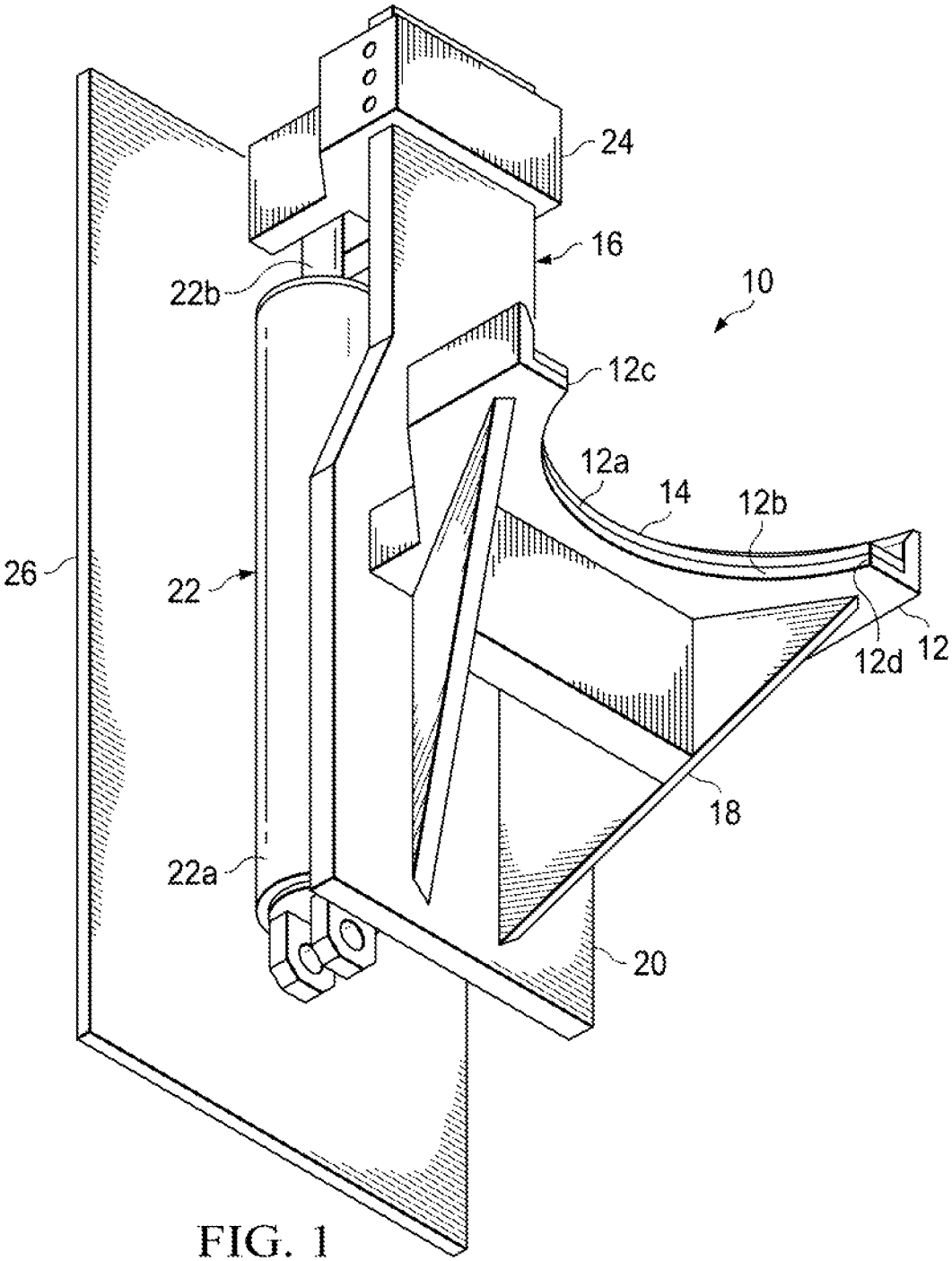
FIG. 1 is a perspective view of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, illustrated is a perspective view of an apparatus 10, which includes a bearing carrier 12 defining an axially-facing surface 12*a*. An arcuate thrust bearing 14 is disposed on the axially-facing surface 12*a*. The bearing carrier 12 is connected to an arm 16, which includes a support 18 and a base 20. The support 18 is connected to the bearing carrier 12 and the base 20. An actuator 22 is connected to the arm 16 at the upper end portion of the base 20. In an exemplary embodiment, as shown in FIG. 1, the actuator 22 is connected to the base 20 via a coupling block 24. The actuator 22 includes a housing 22*a* and an elongated member, such as a rod 22*b*, extending out of the housing 22*a*. The upper end portion of the rod 22*b* is connected to the coupling block 24. The housing 22*a* is connected to a plate 26. In several exemplary embodiments, the housing 22*a* may be connected to the plate 26 via one or more pins, mounting brackets, supports, or any combination thereof. Under conditions to be described below, the actuator 22 controllably actuates the rod 22*b*, causing the rod 22*b* to extend further out of the housing 22*a*, and/or to retract further into the housing 22*a*; as a result of the extension or retraction, the coupling block 24, the arm 16, the bearing carrier 12, and the arcuate thrust bearing 14 move upward or downward, respectively, relative to the housing 22*a* and the plate 26.

As shown in FIG. 1, the bearing carrier 12 includes an arcuate notch 12*b*, which is adjacent the axially-facing surface 12*a*. The arcuate notch 12*b* includes opposing end portions 12*c* and 12*d*. In an exemplary embodiment, the central angle of the arcuate notch 12*b*, which extends circumferentially between the opposing end portions 12*c* and 12*d*, is equal to 180 degrees. In an exemplary embodiment, the central angle extending circumferentially between the opposing end portions 12*c* and 12*d* is less than 180 degrees. In an exemplary embodiment, the central angle extending circumferentially between the opposing end portions 12*c* and 12*d* ranges from less than 180 degrees, for example, at least 90 degrees or at least 120 degrees, to about 180 degrees. In an exemplary embodiment, the central angle extending circumferentially between the opposing end portions 12*c* and 12*d* ranges from about 150 degrees to about 160 degrees.

In an exemplary embodiment, the arcuate thrust bearing 14 is a solid state bushing, or a solid state bearing. In an exemplary embodiment, the arcuate thrust bearing 14 includes or is bronze, steel, or any combination thereof. In an exemplary embodiment, the arcuate thrust bearing 14 includes or is bronze, plastic, steel, a thermoset polymer, one or more other materials, or any combination thereof. It should be understood that the term plastic includes a wide array of polymeric and elastomeric materials, both natural and synthetic, such as natural rubber, polybutadiene polymer, polyethylene, and any combination thereof. In each case, the term combination is meant to include blends, alloys, composites, or any other type of combination of materials. In an exemplary embodiment, the arcuate thrust bearing 14 is formed of one or more component(s) that are softer than the material of a tubular (not shown in FIG. 1), or softer than the material of the support 18 or the base 20, or softer than all of the foregoing.

In several exemplary embodiments, the actuator 22 is, includes, or is part of, a hydraulic actuator, an electromagnetic actuator, a pneumatic actuator, a linear actuator, and/or any combination thereof.

Figure 2:
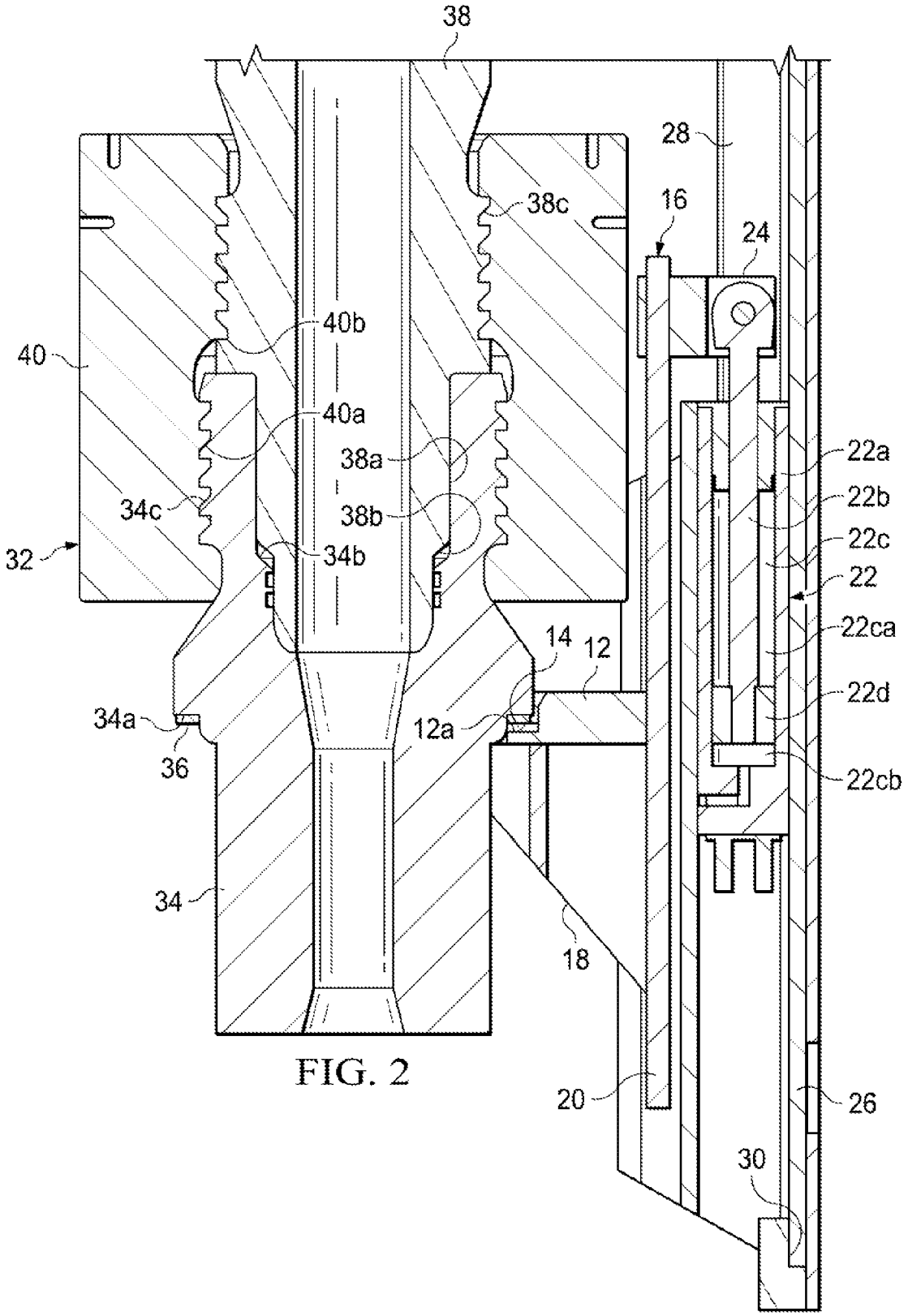
FIG. 2 is a sectional view of the apparatus of FIG. 1 and an assembly engaged therewith, according to one or more aspects of the present disclosure.

Referring to FIG. 2, illustrated is a sectional view of the apparatus 10. The housing 22*a* of the actuator 22 defines an internal region 22*c*. A head, such as a piston 22*d*, is disposed in the internal region 22*c*. The rod 22*b* is connected to the piston 22*d*. The piston 22*d* defines on either side thereof portions 22*ca* and 22*cb* of the region 22*c*. The plate 26 is connected to a structural member 28. In an exemplary embodiment, the plate 26 is connected to the structural member 28 in part by the lower end portion of the plate 26 extending within a channel 30 provided in the structural member 28; the upper end portion of the plate 26 may extend within a corresponding channel (not shown) that faces the channel 30, and/or may be secured to the structural member 28 via, for example, one or more fasteners. In an exemplary embodiment, the plate 26 is connected to the structural member 28 using one or more fasteners. In several exemplary embodiments, the structural member 28 is part of a backup wrench (BUW) of a top drive.

As shown in FIG. 2, a tubular assembly 32 is engaged with the apparatus 10. The tubular assembly 32 includes a tubular component or adapter 34, which includes an external shoulder 34*a*, an internal shoulder 34*b*, and an external threaded connection 34*c* adjacent the upper end of the adapter 34. The adapter 34 extends through the arcuate notch 12*b*. The adapter 34 further includes an annular thrust washer 36, which is disposed on, and connected to, the external annular shoulder 34*a*.

A tubular component 38 is engaged with the adapter 34, and a clamping device 40 releasably connects the tubular component 38 to the adapter 34. More particularly, the tubular component 38 includes a lower end portion 38*a* having an external shoulder 38*b*. The tubular component 38 further includes an external threaded connection 38*c* adjacent the lower end portion 38*a*. The lower end portion 38*a* extends within the upper end portion of the adapter 34 so that the external shoulder 38*b* engages, or is at least proximate, the internal shoulder 34*b*; in an exemplary embodiment, an intermediate material is disposed between the external shoulder 38*b* and the internal shoulder 34*b*. The clamping device 40 extends circumferentially around respective portions of the adapter 34 and the tubular component 38. The clamping device 40 includes axially-spaced internal threaded connections 40*a* and 40*b*, which are threadably engaged with the external threaded connections 34*c* and 38*c*, respectively, thereby connecting the tubular component 38 to the adapter 34. In several exemplary embodiments, the clamping device 40 includes one or more split rings. In several exemplary embodiments, the tubular component 38 is, includes, or is part of, a quill of a top drive, and the structural member 28 is, includes, or is part of, a backup wrench (BUW) of the top drive. In an exemplary embodiment, the clamping device 40 is omitted, and the adapter 34 is combined with the tubular component 38 so that both the adapter 34 and the tubular component 38 (or at least features thereof) are part of a quill of a top drive. In an exemplary embodiment, the clamping device 40 and the adapter 34 are omitted, the tubular component 38 is a quill of a top drive, the tubular component 38 includes one or more of the features of the adapter 34, the tubular component 38 includes the annular thrust washer 36, and the tubular component 38 engages the apparatus 10 directly (rather than via the adapter 34). In an exemplary embodiment, one or more of the adapter 34, the annular thrust washer 36, the tubular component 38, and the clamping device 40 are part of a quill of a top drive.

Figure 3:
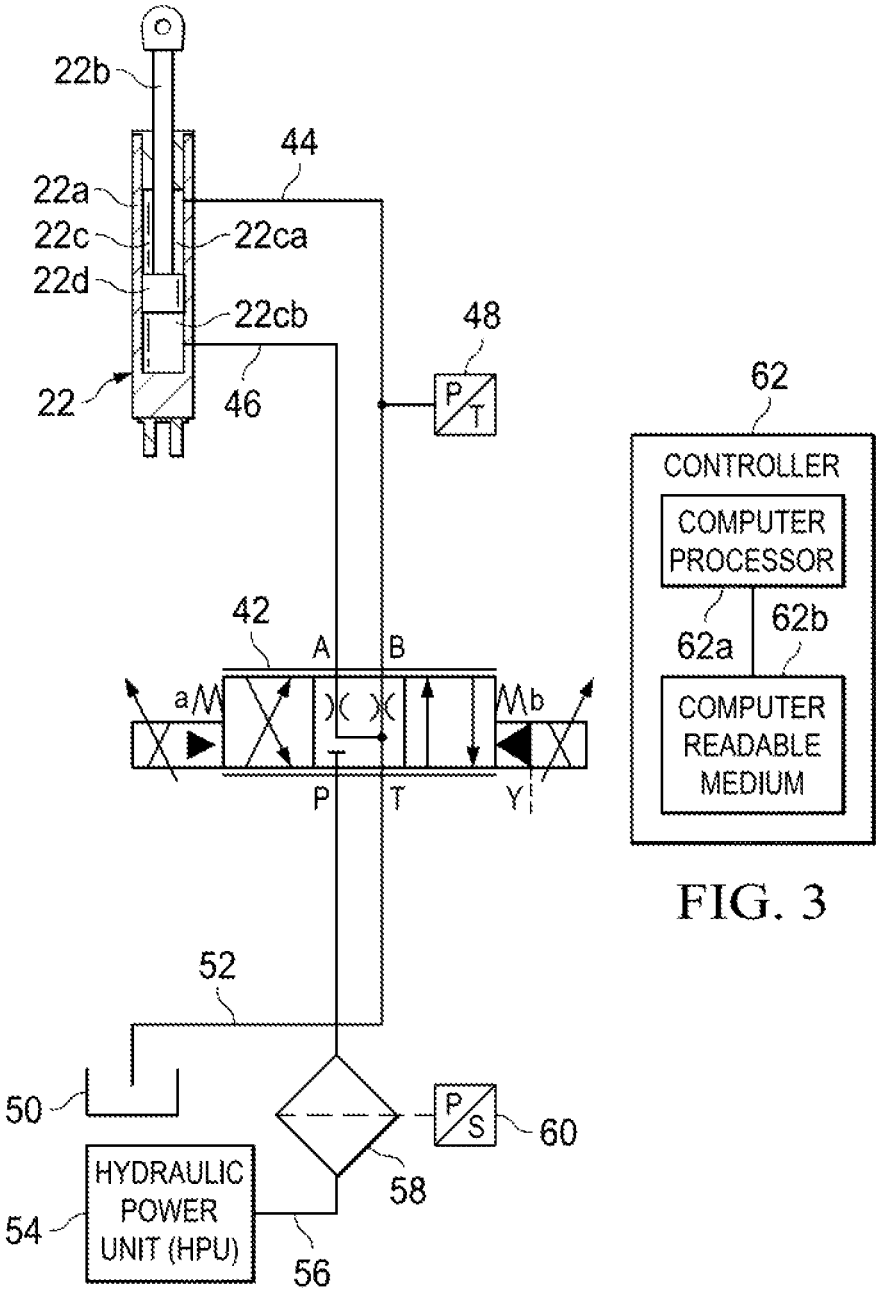
FIG. 3 is a diagrammatic view of a system according to one or more aspects of the present disclosure, the system including a portion of the apparatus of FIG. 1.

Referring to FIG. 3, illustrated is a diagrammatic view of a system that includes the actuator 22. The actuator 22 is a hydraulic actuator, and the housing 22*a* is a cylinder housing. A control valve 42 is in fluid communication with the portions 22*ca* and 22*cb* of the region 22*c* via hydraulic lines 44 and 46, respectively. In an exemplary embodiment, the control valve 42 is a four way, three position valve. In an exemplary embodiment, as shown in FIG. 3, the control valve 42 is a four way, three position, double-solenoid, spring-centered valve, and must be supplied with electrical power in order to move from the position shown in FIG. 3.

Between the control valve 42 and the housing 22*a*, a pressure transducer 48 is in fluid communication with the hydraulic line 44. A reservoir 50 is in fluid communication with the control valve 42 via a tank line 52. A pressurized fluid source, such as a hydraulic power unit 54, is in fluid communication with the control valve 42 via a pressure line 56. Between the hydraulic power unit 54 and the control valve 42, an in-line filter 58 is in fluid communication with the pressure line 56. A pressure switch 60 is operably coupled to the filter 58.

A controller 62 is operably coupled to, and is adapted to control, at least the control valve 42. In an exemplary embodiment, the control valve 42 is either a single solenoid valve or a double solenoid valve, and the controller 62 is operably coupled to the solenoid(s). The controller 62 includes a computer processor 62*a* and a computer readable medium 62*b* operably coupled thereto. Instructions accessible to, and executable by, the computer processor 62*a* are stored on the computer readable medium 62*b*. In an exemplary embodiment, the controller 62 may include one or more programmable logic controllers (PLCs). In an exemplary embodiment, the controller 62 may include a plurality of controllers, the computer processor 62*a* may include a plurality of computer processors, and/or the computer readable medium 62*b* may include a plurality of computer readable mediums. In an exemplary embodiment, the controller 62 may be located at a single location or distributed throughout a plurality of locations. In an exemplary embodiment, the computer readable medium 62*b* may include one or more databases and/or one or more data structures stored therein. In several exemplary embodiments, the computer processor 62*a* may include, for example, one or more of the following: a programmable general purpose controller, an application specific integrated circuit (ASIC), other controller devices, and/or any combination thereof.

Figure 4A:
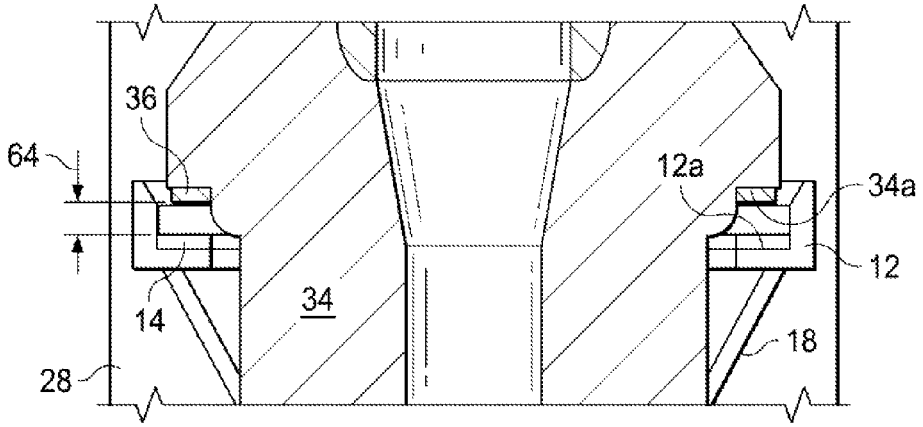
FIG. 4A is a sectional view of respective portions of the apparatus and the assembly engaged therewith of FIG. 2, according to one or more aspects of the present disclosure.
Figure 4B:
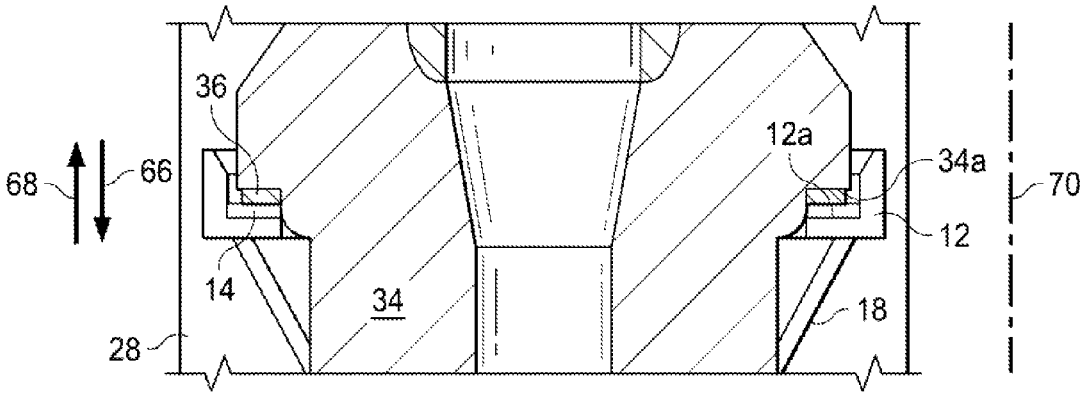
FIG. 4B is a view similar to that of FIG. 4A but depicting a different configuration, according to one or more aspects of the present disclosure.

In operation, referring to FIGS. 4A and 4B with continuing reference to FIGS. 1-3, in an exemplary embodiment, the tubular assembly 32 and the structural member 28 may be suspended in the air, and/or may be suspended in water in, for example, a sea-based operation. During this suspension, the tubular assembly 32 may be rotating about its longitudinal axis in order to, for example, facilitate the drilling of a wellbore. During this rotation, a vertical offset 64 is defined between the arcuate thrust bearing 14 and the thrust washer 36. To provide the vertical offset 64 before the aforementioned rotation of the tubular assembly 32 begins, the control valve 42 permits fluid, such as air or hydraulic fluid, to flow out of at least the portion 22*cb* of the internal region 22*c*. As a result, the rod 22*b*, the piston 22*d*, the coupling block 24, the arm 16 (including the support 18 and the base 20), the bearing carrier 12, and the arcuate thrust bearing 14 move downward, as viewed in FIG. 4A, relative to each of the plate 26, the housing 22*a*, the structural member 28, and the tubular assembly 32. As a result, the vertical offset 64 is provided.

In an exemplary embodiment, when the apparatus 10 is in the configuration shown in FIG. 4A, the thrust washer 36 and the arcuate thrust bearing 14 do not engage each other, and thus are not undergoing any wear and tear. Since the thrust washer 36 and the arcuate thrust bearing 14 do not engage each other during the rotation of the tubular assembly 32, the respective operational lives of the thrust washer 36 and the arcuate thrust bearing 14 are significantly increased and the risk of any failure is reduced.

In an exemplary embodiment, when the apparatus 10 is in the configuration shown in FIG. 4A, electrical power is not supplied to the control valve 42. Since the control valve 42 does not require a constant supply of electrical power during the operation of the apparatus 10, electrical power is conserved in this embodiment. In an exemplary embodiment, when the control valve 42 is a spring-centered valve as illustrated in FIG. 3, the cessation of any supply of electrical power to the control valve 42 causes the control valve 42 to be at the position illustrated in FIG. 3.

In an exemplary embodiment, when the apparatus 10 is in the configuration shown in FIG. 4A, the apparatus 10 may be characterized to be "at rest," with electrical power not being supplied to the control valve 42 and the arcuate thrust bearing 14 not engaging the thrust washer 36, that is, with the vertical offset 64 being provided.

During the suspension of the tubular assembly 32 and the structural member 28, and as necessary or desired, electrical power is supplied to the control valve 42, which, in turn, operates to cause the piston 22*d* to move upward, as viewed in FIGS. 4A and 4B, by controlling the supply of fluid to the portions 22*ca* and 22*cb*. As a result of this upward movement of the piston 22*d*, the rod 22*b*, the coupling block 24, the arm 16 (including the support 18 and the base 20), the bearing carrier 12, and the arcuate thrust bearing 14 move upward, as viewed in FIGS. 4A and 4B. The rod 22*b* extends further out of the housing 22*a*. This upward movement is relative to each of the plate 26, the housing 22*a*, the structural member 28, and the tubular assembly 32. As a result of this upward movement, the vertical offset 64 is eliminated, and the arcuate thrust bearing 14 engages the thrust washer 36. As a result of this engagement, the arcuate thrust bearing 14 supports, at least in part, the tubular assembly 32 and any other components connected thereto.

As shown in FIG. 4B, during the engagement between the arcuate thrust bearing 14 and the thrust washer 36, the tubular assembly 32 is permitted to move, relative to the structural member 28, in a downward direction indicated by an arrow 66. In several exemplary embodiments, the tubular assembly 32 may undergo no movement at all, almost no movement, or negligible movement. In several exemplary embodiments, the movement of the tubular assembly 32 may range from negligible movement up to about 6 inches of movement, about 12 inches of movement, or about 24 inches of movement. The movement can thus be pre-set to be any number of quarter inches of movement between ¼ inch and 24 inches, as needed in a given drilling environment depending on various factors known to those of ordinary skill in the art.

To the extent that the tubular assembly 32 moves in the direction indicated by the arrow 66 (i.e., relatively downward), the piston 22*d*, the rod 22*b*, the coupling block 24, the arm 16 (including the base 20 and the support 18), the bearing carrier 12, and the arcuate thrust bearing 14 also move, relative to each of the plate 26, the structural member 28, and the housing 22*a*, in the direction indicated by the arrow 66. The rod 22*b* retracts further into the housing 22*a*. The arcuate thrust bearing 14 continues to support the tubular assembly 32.

In response to permitting the tubular assembly 32 to move in the direction indicated by the arrow 66, a force is applied, in the direction indicated by the arrow 66, against a tubular member (not shown), which is spaced from the tubular assembly 32 in the direction indicated by the arrow 66. The force applied in the direction indicated by the arrow 66 is due, at least in part, to the weight of the tubular assembly 32 and the ability of the tubular assembly 32 to move relative to the structural member 28. The force applied in the direction indicated by the arrow 66 may also be due to additional components hanging below the tubular assembly 32.

To reduce the force applied in the direction indicated by the arrow 66, the control valve 42 selectively supplies fluid to the portion 22*cb* of the internal region 22*c*, thereby applying a force against the piston 22*d* in a direction indicated by an arrow 68 (i.e., relatively upwards), which is opposite to the direction indicated by the arrow 66. The arm 16 and the coupling block 24 transfer to the rod 22*b* the force applied in the direction indicated by the arrow 66; however, this transferred force applied in the direction indicated by the arrow 66 is counteracted by the force applied against the pistons 22*d* in the direction indicated by the arrow 68.

In response to the force against the piston 22*d* in the direction indicated by the arrow 68, the tubular assembly 32 rises in the direction indicated by the arrow 68. More particularly, the rod 22*d* extends further out of the housing 22*a*, causing the coupling block 24, the arm 16, the bearing carrier 12, the arcuate thrust bearing 14, and thus the tubular assembly 32, to rise in the direction indicated by the arrow 68. As a result of the lifting of the tubular assembly 32, the force applied in the direction 66, which is due at least in part to the weight of the tubular assembly 32, is at least reduced or partially counteracted. Thus, the effective weight of the tubular assembly 32, or any larger assembly of which the tubular assembly 32 may be a part, is reduced. In an exemplary embodiment, the tubular assembly 32 may be lifted by about 8 inches. In an exemplary embodiment, the tubular assembly 32 may be lifted by less than 8 inches, or greater than 8 inches, including any other matching distance noted herein for the tubular assembly.

To the extent that the tubular assembly 32 moves in the direction indicated by the arrow 68, the rod 22*b*, the coupling block 24, the arm 16, the bearing carrier 12, and the arcuate thrust bearing 14 also move, relative to each of the plate 26, the housing 22*a*, and the structural member 28, in the direction indicated by the arrow 68. The arcuate thrust bearing 14 continues to support the tubular assembly 32.

In an exemplary embodiment, when the apparatus 10 is in the configuration shown in FIG. 4A, the apparatus 10 may be characterized to be "active," with electrical power being supplied to the control valve 42 and the arcuate thrust bearing 14 engaging the thrust washer 36.

In several exemplary embodiments, the force in the direction indicated by the arrow 66 may be applied to the above-noted tubular member, which is spaced from the tubular assembly 32 in the direction indicated by the arrow 66, to threadably engage (or make-up) the tubular member with another tubular member located therebelow to form, or continue to form, a string of drill pipe or casing. Alternatively, in several exemplary embodiments, the force in the direction indicated by the arrow 66 may be applied to threadably disengage (or break-out) the tubular member from another tubular member located therebelow. By employing the apparatus 10 to reduce the effective weight of the tubular assembly 32 or any larger assembly of which the tubular assembly 32 may be a part, the risk or potential of damaging threads is reduced during, for example, threadably engaging the tubular member with another tubular member, or threadably disengaging the tubular member from the other tubular member. As a result, careful make-up or break-out of two tubular members can be facilitated.

In several exemplary embodiments, the tubular component 38 may be a quill of a top drive, the structural member 28 may be part of a backup wrench (BUW) of the top drive, the top drive may be suspended in the air (or water), and the quill (including the tubular component 38) may be movable, relative to the BUW (including the structural member 28), during the suspension of the top drive and the operation of the apparatus 10, which operates in the above-described manner to reduce the effective weight of the quill.

In an exemplary embodiment, after the make-up or break-out of the two tubular members, the apparatus 10 may again be placed in the configuration shown in FIG. 4A. In an exemplary embodiment, the apparatus 10 may be placed in the configuration shown in FIG. 4A simply by stopping the supply of electrical power to the control valve 42 and allowing gravitational forces to cause the piston 22*d*, the rod 22*b*, the coupling block 24, the arm 16, the bearing carrier 12, and the arcuate thrust bearing 14 to move downward, relative to the tubular assembly 32, thereby again providing the vertical offset 64.

In several exemplary embodiments, the bearing carrier 12 only engages and thus supports the tubular assembly 32 when necessary, such as when the tubular assembly 32 is used to make-up or break-out two tubular members. As a result, wear on the arcuate thrust bearing 14 and the thrust washer 36 is reduced, as is the risk of any failure. Similarly, electrical power is only supplied to the control valve 42 when necessary, such as when the tubular assembly 32 is used to make-up or break-out two tubular members. As a result, electrical power is conserved.

In several exemplary embodiments, during operation of the apparatus 10, the control valve 42 selectively supplies fluid to the portions 22*ca* and 22*cb* of the internal region 22*c*. By employing the control valve 42 to control the supply of fluid to the portions 22*ca* and 22*cb*, the rod 22*b* may be placed at a predetermined position along an axis 70 (shown in FIG. 4B) that extends along the respective directions indicated by the arrows 66 and 68. Therefore, when the apparatus 10 supports the tubular assembly 32 as shown in FIG. 4B, the tubular assembly 32 may also be placed at a predetermined position along the axis 70.

In an exemplary embodiment, the controller 62 controls the operation of at least the control valve 42 to controllably place at least the arcuate thrust bearing 14 at a predetermined position along the axis 70. In an exemplary embodiment, the controller 62 controls the operation of at least the control valve 42 to control the speed or rate of displacement of at least the arcuate thrust bearing 14 along the axis 70.

In an exemplary embodiment, during the above-described operation of the apparatus 10, the pressure transducer 48 measures the pressure in the hydraulic line 44 and transmits data or signals to the controller 62 corresponding to the measured pressure, thereby providing feedback to the controller 62 during its control and operation of the control valve 42. In an exemplary embodiment, during the above-described operation of the apparatus 10, the filter 58 filters out debris or particles from the fluid being supplied from the hydraulic power unit 54. The pressure switch 60 measures the pressure upstream and downstream of the filter 58, and provides an alarm or signal when the pressure drop across the filter 58 becomes too high and thus the filter 58 needs to be serviced or replaced.

In several exemplary embodiments, the computer processor 62*a* executes instructions stored on the computer readable medium 62*b* to carry out the above-described operation of the apparatus 10.

In an exemplary embodiment, the apparatus 10 may be easily disengaged from the structural member 28 and the tubular assembly 32. In particular, instead of having an annular shape that extends circumferentially all the way around the adapter 34, the arcuate notch 12*b* of the bearing carrier 12 has an arcuate shape, which facilitates its easy disengagement from the tubular assembly 32, regardless of whether the apparatus 10 is in the configuration illustrated in FIG. 4A or the configuration illustrated in FIG. 4B. The arcuate notch 12*b* also facilitates the reengagement of the apparatus 10 with the tubular assembly 32 and the structural member 28. Conversely, the arcuate notch 12 facilitates the disengagement of the tubular assembly 32 (or components thereof) from the apparatus 10, as well as the reengagement of the tubular assembly 32 (or components thereof) with the apparatus 10.

Figure 5:
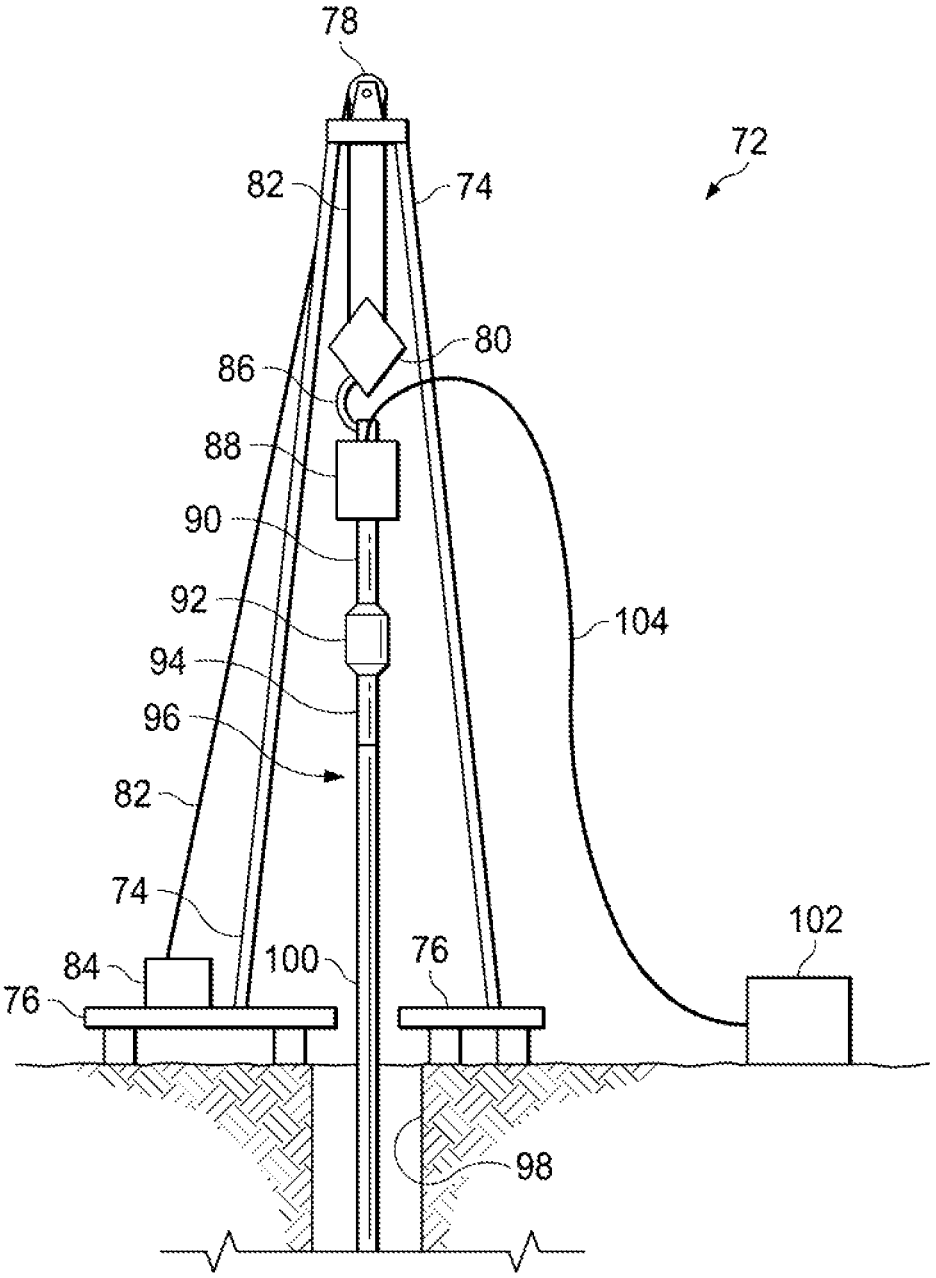
FIG. 5 is a schematic view of an apparatus according to one or more aspects of the present disclosure.

Referring to FIG. 5 with continuing reference to FIGS. 1-4B, an apparatus is generally referred to by the reference numeral 72 and demonstrates an exemplary environment in which the apparatus 10 or portions thereof shown in one or more of FIGS. 1, 2, 3, 4A and 4B, and/or other apparatus within the scope of the present disclosure, may be implemented. The apparatus 72 is or includes a land-based drilling rig. However, one or more aspects of the present disclosure are applicable or readily adaptable to any type of drilling rig, such as jack-up rigs, semisubmersibles, drill ships, coil tubing rigs, and casing drilling rigs, among others.

The apparatus 72 includes a mast 74 supporting lifting gear above a rig floor 76. The lifting gear includes a crown block 78 and a traveling block 80. The crown block 78 is coupled at or near the top of the mast 74, and the traveling block 80 hangs from the crown block 78 by a drilling line 82. The drilling line 82 extends from the lifting gear to drawworks 84, which is configured to reel the drilling line 82 out and in to cause the traveling block 80 to be lowered and raised relative to the rig floor 76. A hook 86 may be attached to the bottom of the traveling block 80. A top drive 88 may be suspended from the hook 86, and may include a quill 90. The quill 90 may extend downward, as viewed in FIG. 5, and may be attached to a saver sub 92, which may be attached to a tubular lifting device 94. The quill 90 may include the tubular component 38 shown in FIGS. 2, 4A and 4B, with which the apparatus 10 is engaged as described above. The top drive 88 may include a backup wrench (BUW), which may include the structural member 28 shown in FIGS. 2, 4A and 4B, to which the apparatus 10 is connected as described above.

As shown in FIG. 5, the tubular lifting device 94 can be engaged with a drill string 96 suspended within and/or above a wellbore 98. The drill string 96 may include one or more tubular members 100, the majority of which are interconnected to one another and one of which may be either threadably disengaged from, or threadably engaged with, another of the tubular members 100. The tubular members 100 may be part of a string of drill pipe or casing. It should be understood that various other types of tubular members, or tubulars, can often be substituted depending on the desired operation. In addition to the tubular members 100, the drill string 96 may include other components. One of the tubular members 100 may be the tubular member to which the force is applied in the direction indicated by the arrow 66 in FIG. 4B, the force being due, at least in part, to the weight of at least the quill 90, including the weight of at least the tubular component 38; that is, the force that is reduced as a result of the above-described operation of the apparatus 10. As shown in FIG. 5, one or more pumps 102 may deliver drilling fluid to the drill string 96 through a hose or other conduit 104, which may be connected to the top drive 88. The drilling fluid may pass through a central passage of the tubular lifting device 94.

In an exemplary embodiment, the top drive 88, quill 90 and saver sub 92 may not be utilized between the hook 86 and the tubular lifting device 94, such as where the tubular lifting device 94 is coupled directly to the hook 86, or where the tubular lifting device 94 is coupled to the hook 86 via other components.

In several exemplary embodiments, instead of a drilling rig, the apparatus 72 may be any device that requires reducing the effective weight of a structure being moved or used in an operation where the structure engages, or causes another structure to engage, a delicate, fragile, or easily-damaged component or portion thereof (such as a threaded connection), so that the weight reduction reduces, minimizes or prevents damage to the component or portion thereof.

In view of the above and the figures, one of ordinary skill in the art will readily recognize that the present disclosure introduces an apparatus that includes a thrust bearing adapted to engage a tubular component having a weight; a bearing carrier connected to the thrust bearing, the bearing carrier including an arcuate notch through which the tubular component is adapted to extend, the arcuate notch including opposing end portions and defining an angle extending circumferentially between the opposing end portions, the angle ranging from less than 180 degrees to about 180 degrees; an arm connected to the bearing carrier and to which a first force in a first direction is adapted to be applied by a least a portion of the weight of the tubular component; and an actuator connected to the arm to apply thereto a second force in a second direction to at least partially counteract the first force, the second direction being opposite to the first direction. According to one aspect, the angle ranges from about 150 degrees to about 160 degrees. According to another aspect, the bearing carrier defines an axially-facing surface adjacent the arcuate notch; and the thrust bearing is an arcuate thrust bearing disposed on the axially-facing surface and adapted to engage the tubular component. According to yet another aspect, the apparatus includes the tubular component, the tubular component including an external shoulder and a thrust washer connected thereto; wherein the apparatus has: a first configuration in which the arcuate thrust bearing is not engaged with the thrust washer and a vertical offset is defined between the arcuate thrust bearing and the thrust washer; and a second configuration in which the arcuate thrust bearing engages the thrust washer to support the tubular component. According to still yet another aspect, the actuator includes a housing defining an internal region; a head disposed in the internal region, the head defining on either side thereof first and second portions of the internal region; and an elongated member connected to the head and extending out of the housing; wherein the arm is connected to the elongated member; wherein the apparatus further includes a control valve in fluid communication with each of the first and second portions of the internal region; wherein a cessation of a supply of electrical power to the control valve places the apparatus in the first configuration. According to still yet another aspect, the apparatus includes a top drive which includes a quill, wherein the tubular component is connected to, or is part of, the quill; and a backup wrench to which the housing is connected; wherein the quill, the tubular component, the arcuate thrust bearing, the bearing carrier, the arm, the elongated member, and the head are movable, relative to the backup wrench and the housing, in the first and second directions.

The present disclosure also introduces an apparatus that includes a tubular component having a weight; a thrust bearing adapted to engage the tubular component for the support thereof; a bearing carrier to which the thrust bearing is connected; an arm connected to the bearing carrier and to which a first force is adapted to be applied by at least a portion of the weight of the tubular component; an actuator connected to the arm and adapted to apply to the arm a second force to at least partially counteract the first force; and a structural member to which the actuator is connected; wherein the apparatus has a first configuration in which the thrust bearing is not engaged with the tubular component and a vertical offset is defined between the tubular component and the thrust bearing, and a second configuration in which the thrust bearing is engaged with the tubular component for the support thereof; and wherein the actuator moves the thrust bearing, the bearing carrier, and the arm, relative to each of the structural member and the tubular component, to place the apparatus in the second configuration. According to one aspect, the bearing carrier defines an axially-facing surface; wherein the bearing carrier includes an arcuate notch adjacent the axially-facing surface and through which the tubular component extends, the arcuate notch including opposing end portions and defining an angle extending circumferentially between the opposing end portions, the angle ranging from less than 180 degrees to about 180 degrees; and wherein the thrust bearing is an arcuate thrust bearing disposed on the axially-facing surface. According to another aspect, the angle ranges from about 150 degrees to about 160 degrees. According to yet another aspect, the tubular component includes an external shoulder and a thrust washer connected thereto; wherein, when the apparatus is in the first configuration, the arcuate thrust bearing is not engaged with the thrust washer and the vertical offset is defined between the arcuate thrust bearing and the thrust washer; and wherein, when the apparatus is in the second configuration, the arcuate thrust bearing engages the thrust washer to support the tubular component. According to still yet another aspect, the actuator includes a housing defining an internal region; a head disposed in the internal region, the head defining on either side thereof first and second portions of the internal region; and an elongated member connected to the head and extending out of the housing, wherein the arm is connected to the elongated member; and wherein the apparatus further includes a control valve in fluid communication with each of the first and second portions of the internal region. According to still yet another aspect, a cessation of a supply of electrical power to the control valve places the apparatus in the first configuration. According to still yet another embodiment, the apparatus includes a top drive, the top drive including a quill, wherein the tubular component is connected to, or is part of, the quill; and the structural member, wherein the structural member is a backup wrench.

The present disclosure also introduces an apparatus that includes a thrust bearing adapted to engage a tubular component having a weight; a bearing carrier connected to the thrust bearing; an arm connected to the thrust bearing and to which a first force in a first direction is adapted to be applied by a least a portion of the weight of the tubular component; and an actuator connected to the arm to apply thereto a second force in a second direction to at least partially counteract the first force, the second direction being opposite to the first direction, the actuator including a housing defining an internal region; a head disposed in the internal region, the head defining on either side thereof first and second portions of the internal region; and an elongated member connected to the head and extending out of the housing, the elongated member being connected to the arm; and a control valve in fluid communication with each of the first and second portions of the internal region; wherein the actuator is adapted to be connected to a structural member; and wherein, when the actuator is connected to the structural member, the thrust bearing, the bearing carrier, the arm, the head, and the elongated member move in the first direction, relative to structural member, in response to a cessation of a supply of electrical power to the control valve. According to one embodiment, the apparatus includes the structural member to which the actuator is connected; and the tubular component with which the thrust bearing is adapted to be engaged; wherein the apparatus has a first configuration in which the thrust bearing is not engaged with the tubular component and a vertical offset is defined between the tubular component and the thrust bearing, and a second configuration in which the thrust bearing is engaged with the tubular component for the support thereof; and wherein the apparatus is placed in the first configuration in response to the cessation of the supply of the electrical power to the control valve. According to another embodiment, the actuator moves the thrust bearing, the bearing carrier, and the arm, relative to each of the structural member and the tubular component, to place the apparatus in the second configuration. According to yet another embodiment, the bearing carrier includes an arcuate notch through which the tubular component is adapted to extend, the arcuate notch including opposing end portions and defining an angle extending circumferentially between the opposing end portions, the angle ranging from less than 180 degrees to about 180 degrees. According to still yet another embodiment, the angle ranges from about 150 degrees to about 160 degrees. According to still yet another embodiment, the bearing carrier defines an axially-facing surface adjacent the arcuate notch; and wherein the thrust bearing is an arcuate thrust bearing disposed on the axially-facing surface and adapted to engage the tubular component. According to still yet another embodiment, the apparatus includes a top drive, the top drive including a quill, wherein the tubular component is connected to, or is part of, the quill; and the structural member, wherein the structural member is a backup wrench.

The present disclosure also introduces an apparatus according to one or more embodiments of the present disclosure.

The present disclosure also introduces a method including at least one step according to one or more aspects of the present disclosure.

The present disclosure also introduces a system comprising at least one component having at least one character according to one or more aspects of the present disclosure.

The present disclosure also introduces a kit including at least one component having at least one character according to one or more aspects of the present disclosure.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112(f) for any limitations of any of the claims herein, except for those in which the claim expressly uses the word "means" together with an associated function.

What is claimed is:

1. An apparatus, comprising:

a tubular component having a weight, the tubular component comprising an external shoulder and a thrust washer connected thereto;

a thrust bearing adapted to engage the tubular component;

a bearing carrier connected to the thrust bearing, the bearing carrier comprising an arcuate notch through which the tubular component is adapted to extend, the arcuate notch comprising opposing end portions and defining an angle extending circumferentially between the opposing end portions, the angle ranging from less than 180 degrees to about 180 degrees, the bearing carrier defining an axially-facing surface adjacent the arcuate notch;

wherein the thrust bearing is an arcuate thrust bearing disposed on the axially-facing surface;

an arm connected to the bearing carrier and to which a first force in a first direction is adapted to be applied by at least a portion of the weight of the tubular component;

an actuator connected to the arm to apply thereto a second force in a second direction to at least partially counteract the first force, the second direction being opposite to the first direction, the actuator comprising:

a housing defining an internal region;

a head disposed in the internal region, the head defining on either side thereof first and second portions of the internal region; and an elongated member is connected to the arm and connected to the head, the elongated member extending out of the housing;

a control valve in fluid communication with each of the first and second portions of the internal region; and a top drive comprising:

a quill, wherein the tubular component is connected to, or is part of, the quill; and a backup wrench to which the housing is connected;

wherein the apparatus has:

a first configuration in which the arcuate thrust bearing is not engaged with the thrust washer, and a vertical offset is defined between the arcuate thrust bearing and the thrust washer; and a second configuration in which the arcuate thrust bearing engages the thrust washer to support the tubular component; and wherein the quill, the tubular component, the arcuate thrust bearing, the bearing carrier, the arm, the elongated member, and the head are movable, relative to the backup wrench and the housing, in the first and second directions.

2. The apparatus of claim 1, wherein the angle ranges from about 150 degrees to about 160 degrees.

3. The apparatus of claim 1, wherein a cessation of a supply of electrical power to the control valve places the apparatus in the first configuration.

4. An apparatus, comprising:

a tubular component having a weight;

a thrust bearing having an axially-facing surface adapted to engage the tubular component for the support thereof;

a bearing carrier to which the thrust bearing is connected;

an arm connected to the bearing carrier and to which a first force is adapted to be applied by at least a portion of the weight of the tubular component;

an actuator connected to the arm and adapted to apply to the arm a second force to at least partially counteract the first force; and a structural member to which the actuator is connected;

wherein the apparatus has a resting configuration, associated with the tubular component being rotated during drilling operations, in which the thrust bearing is not engaged with the tubular component and a vertical offset is defined between the tubular component and the thrust bearing, and an active configuration in which the thrust bearing is engaged with the tubular component for the support thereof; and wherein the actuator moves the thrust bearing, the bearing carrier, and the arm, relative to each of the structural member and the tubular component, to place the apparatus in the active configuration.

5. The apparatus of claim 4, wherein the bearing carrier defines an axially-facing surface;

wherein the bearing carrier comprises an arcuate notch adjacent the axially-facing surface of the bearing carrier and through which the tubular component extends, the arcuate notch comprising opposing end portions and defining an angle extending circumferentially between the opposing end portions, the angle ranging from less than 180 degrees to about 180 degrees; and wherein the thrust bearing is an arcuate thrust bearing disposed on the axially-facing surface of the bearing carrier.

6. The apparatus of claim 5, wherein the angle ranges from about 150 degrees to about 160 degrees.

7. The apparatus of claim 5, wherein the tubular component comprises an external shoulder and a thrust washer connected thereto;

wherein, when the apparatus is in the resting configuration, the arcuate thrust bearing is not engaged with the thrust washer and the vertical offset is defined between the arcuate thrust bearing and the thrust washer; and wherein, when the apparatus is in the active configuration, the axially-facing surface of the arcuate thrust bearing engages the thrust washer to support the tubular component.

8. The apparatus of claim 4, wherein the actuator comprises:

a housing defining an internal region;

a head disposed in the internal region, the head defining on either side thereof first and second portions of the internal region; and an elongated member connected to the head and extending out of the housing, wherein the arm is connected to the elongated member; and wherein the apparatus further comprises a control valve in fluid communication with each of the first and second portions of the internal region.

9. The apparatus of claim 8, wherein a cessation of a supply of electrical power to the control valve places the apparatus in the first resting configuration.

10. The apparatus of claim 4, further comprising a top drive, the top drive comprising:

a quill, wherein the tubular component is connected to, or is part of, the quill; and the structural member, wherein the structural member is a backup wrench.

11. An apparatus, comprising:

a thrust bearing adapted to engage a tubular component having a weight;

a bearing carrier connected to the thrust bearing;

an arm connected to the thrust bearing and to which a first force in a first direction is adapted to be applied by at least a portion of the weight of the tubular component; and an actuator connected to the arm to apply thereto a second force in a second direction to at least partially counteract the first force when a tubular member coupled to the tubular component is threadably engaged or threadably disengaged with another tubular member, the second direction being opposite to the first direction, the actuator comprising:

a housing defining an internal region;

a head disposed in the internal region, the head defining on either side thereof first and second portions of the internal region; and an elongated member connected to the head and extending out of the housing, the elongated member being connected to the arm;

and a control valve in fluid communication with each of the first and second portions of the internal region;

wherein the actuator is adapted to be connected to a structural member; and wherein, when the actuator is connected to the structural member, the thrust bearing, the bearing carrier, the arm, the head, and the elongated member move in the first direction, relative to the structural member, in response to a cessation of a supply of electrical power to the control valve.

12. The apparatus of claim 11, further comprising:

the structural member to which the actuator is connected; and the tubular component with which the thrust bearing is adapted to be engaged;

wherein the apparatus has a first configuration in which the thrust bearing is not engaged with the tubular component and a vertical offset is defined between the tubular component and the thrust bearing, and a second configuration in which the thrust bearing is engaged with the tubular component for the support thereof; and wherein the apparatus is placed in the first configuration in response to the cessation of the supply of the electrical power to the control valve.

13. The apparatus of claim 12, wherein the actuator moves the thrust bearing, the bearing carrier, and the arm, relative to each of the structural member and the tubular component, to place the apparatus in the second configuration.

14. The apparatus of claim 11, wherein the bearing carrier comprises an arcuate notch through which the tubular component is adapted to extend, the arcuate notch comprising opposing end portions and defining an angle extending circumferentially between the opposing end portions, the angle ranging from less than 180 degrees to about 180 degrees.

15. The apparatus of claim 14, wherein the angle ranges from about 150 degrees to about 160 degrees.

16. The apparatus of claim 14, wherein the bearing carrier defines an axially-facing surface adjacent the arcuate notch; and wherein the thrust bearing is an arcuate thrust bearing disposed on the axially-facing surface and adapted to engage the tubular component.

17. The apparatus of claim 11, further comprising a top drive, the top drive comprising:

a quill, wherein the tubular component is connected to, or is part of, the quill; and the structural member, wherein the structural member is a backup wrench.

* * * * *